United States Patent [19]

Beauregard

[11] 4,162,562

[45] Jul. 31, 1979

[54] LOOM FOR HIGH WARP TAPESTRY

[76] Inventor: Andree Beauregard, 477, Saint-François-Xavier, Bureau 204, Montreal, Quebec, Canada

[21] Appl. No.: 889,482

[22] Filed: Mar. 23, 1978

[51] Int. Cl.[2] ..... D03D 29/00

[52] U.S. Cl. ..... 28/151; 139/34

[58] Field of Search ..... 139/29, 33, 34; 28/149, 28/150, 151, 152

[56] References Cited

U.S. PATENT DOCUMENTS

| | | | |
|---|---|---|---|
| 764,479 | 7/1904 | Lindberg | 28/151 |
| 2,601,222 | 6/1958 | Wehrli | 28/151 |

FOREIGN PATENT DOCUMENTS

| | | | |
|---|---|---|---|
| 671980 | 9/1929 | France | 28/151 |

*Primary Examiner*—Henry Jaudon

*Attorney, Agent, or Firm*—Swabey, Mitchell, Houle, Marcoux & Sher

[57] ABSTRACT

The disclosure describes a loom for high warp tapestry which is made of a frame mounted on a base and wherein the frame is adapted to receive a weft in downwardly displaceable fashion along its length. The frame is made of two substantially parallel upright vertical members, an upper guide bar and a lower guide bar. Both guide bars should enable the warp to slide over and above them respectively. Both ends of the warp are mounted at the rear of the frame in transverse members which can be adjusted by drawing them closer together thereby producing predetermined and uniform tension in the warp. This loom is especially adapted to control the tension of the warp especially in the case where the thickness of the high warp tapestry is not uniform.

13 Claims, 3 Drawing Figures

LOOM FOR HIGH WARP TAPESTRY

BACKGROUND OF THE INVENTION

This invention relates to a loom for high warp tapestry. More particularly, the invention relates to a loom which assures a uniform and predetermined tension regardless of the type of warp.

One of the most serious problems in creating a tapestry, is the obtaining of a tension in the warp which is high enough, and is constantly uniform. It is well known indeed, that if these conditions are not maintained, the tapestry will not be regular, for example, along its sides. In a standard loom, the upper end and lower end of the warp are usually fixed into loom rollers where sufficient tension is maintained by rotating one or both of the rollers. This is generally satisfactory when making a normal tapestry of uniform thickness. However, when creating tapestries of variable thicknesses, as it is now done in modern craft, it is nearly impossible to maintain uniform tension of the warp to create a work of art which is free of defects in its appearance.

There has been some suggestions to stack the rollers underneath the warp with all kinds of material in order to produce the desired uniform tension. However, this has proved to be troublesome, cumbersome and in most cases, unsatisfactory.

U.S. Pat. No. 3,738,395 makes a suggestion to apply tension to the warp threads by using a flexible resilient assembly which applies tension on the bar retaining the upper warp. However, thus suggestion which may be useful when creating small craft pieces, would not be of great value in working with high warp tapestry because the warp has to be moved lengthwise.

SUMMARY OF THE INVENTION

It is an object of the present invention to overcome the above disadvantages by providing an improved loom which produces predetermined and uniform tension in the warp.

In accordance with the present invention, in a loom for high warp tapestry which is made of a substantially rectangular frame mounted on a base, and wherein the frame is adapted to receive a warp in downwardly displaceable fashion along its length, there is provided the improvement wherein the frame is made of two substantially parallel upright vertical members, an upper guide bar and a lower guide bar. The upper guide bar and the lower guide bar have means to permit sliding of the warp along the upper and lower guide bars. Means are provided for separately mounting both ends of the warp at the rear of the frame and the mounting means are associated with adjustable means for drawing the ends of the warp closer together, thereby producing predetermined and uniform tension in the warp.

The invention will now be described with reference to the accompanying drawings which are given for the purpose of illustration only, and in which, FIG. 1 is a perspective view showing the rear of the loom and the tension producing transverse members according to the invention;

Figure 1:
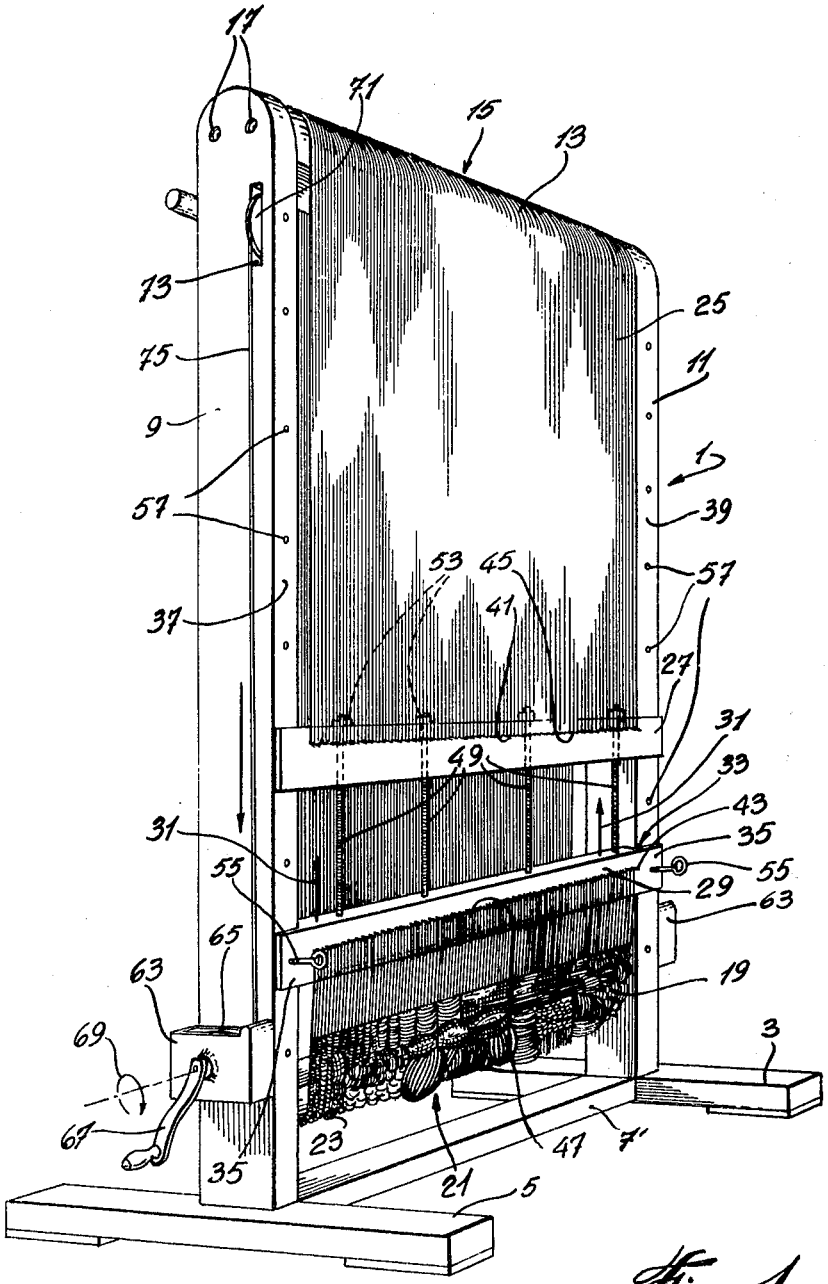

Referring now to the drawings, there is shown a loom 1 for high warp tapestry which basically consists of a frame which is rectangular. The frame sits on an I-base formed of two stabilizing pieces 3 and 5 which are both connected by means of a cross-bar 7.

Coming back to the frame, the latter is made of two upright vertical members 9 and 11 which are parallel to one another and are preferably made of wood, for example they can consist of two thick boards of hard wood.

The uppermost horizontal part of the frame consists of an upper guide bar 13 which is made of a half rounded elongated wood member. Referring to FIG. 1, it will be seen that the upper guide bar 13 is mounted between the upper ends of the upright members 9 and 11, with the rounded portion facing upwards as shown. In order to mount the upper guide bar 13 and the upright vertical members 9 and 11 together, as shown in the drawings, bolts 17 are used. However, any other mode of fixation can obviously be used.

Figure 2:
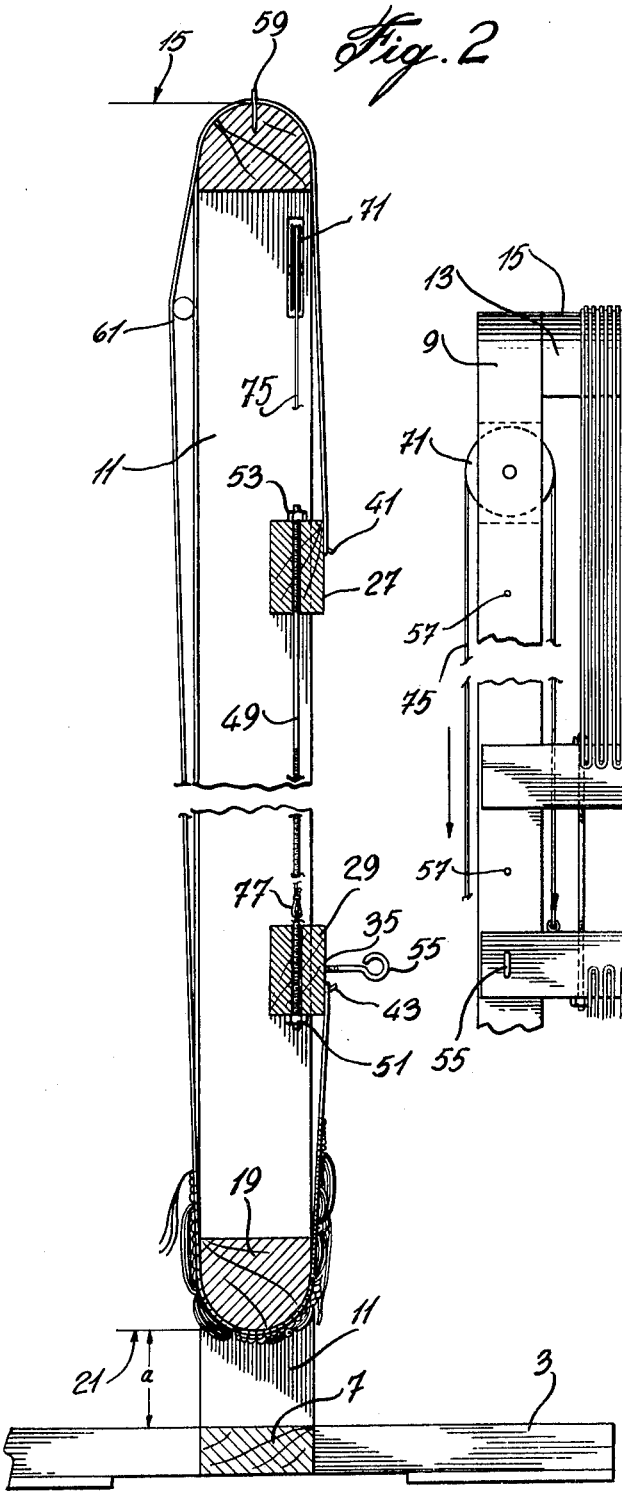
FIG. 2 is a cross-section in elevation of the loom.

Turning now to the lower part of the frame, the latter will be seen to consist of a lower guide bar 19 which is also constructed as a half rounded elongated member as in the case of upper guide bar 13. As illustrated in FIGS. 1 and 2, the lower guide bar 19 is mounted between the upright members 9 and 11 with the rounded portion 21 facing downwards.

The lower guide bar 19 should be at a distance "a", as shown in FIG. 2 from the lower ends of the upright members 9 and 11, and from the cross-bar 7 of the base. This distance "a" could vary to some extent, but it should be sufficient to enable a finished portion of the high warp tapestry 23 to slide lengthwise around the rounded portion 21 of the lower guide bar 19 without being disturbed by the base. It will be realised that when the finished portion of the high warp tapestry 23 slides around the rounded portion 21, the upper portion of the warp 25 slides length-wise over the rounded portion 15 of the upper guide bar 13.

Referring more particularly to FIGS. 1 and 2, the loom 1 has a pair of transverse horizontal holding members 27 and 29, 27 representing the upper holding member while 29 represents the lower transverse horizontal holding member. As illustrated in FIG. 1, it will be seen that the holding members 27,29 are both parallel to one another and should be capable of sliding along the upright vertical members 9 and 11, at the rear of the frame, in the direction indicated by the arrow 31. In order to enable both holding members 27,29 to move upward by sliding along the vertical upright members 9, 11, each holding member has a shoulder defining cut-out portion formed at both ends of each holding member 9, 11. These cut-out portions should be made to enable the holding members 27, 29 to fit exactly between the upright members 9, 11 in slidable relationship with respect to the upright members. This cut-out portion defines shoulders 35 which enables the holding members 27, 29 to rest over the upright members 27, 29 against the rear face thereof, so as to enable them to ride against the edges 37, 29 respectively of the vertical upright members 9, 11.

Each holding member is provided with a comb 41, 43, respectively for holding members 27, 29. As shown, each comb consists of a row of nails which are horizontally driven in the outer face of each of the holding members 27, 29. The comb 41 will be used to hook the threads at the upper end 45 of the warp 25 while the comb 43 will be used to hook the threads at the lower end 47 of the warp 25.

The idea which has given rise to the present invention is to pull on both ends 45 and 47 of the warp 25 in order to provide sufficient and uniform tension in the warp, especially in the front portion thereof, where the person making the high warp tapestry is working. For this purpose, there are provided a plurality of bolts 49 which extend from the lower transverse holding member 29 to the upper transverse holding member 27. In view of the fact that all the bolts are similar, it will be merely sufficient to describe one of them, with particular reference to FIG. 1. Bolt 49 is threaded at both ends thereof and is long enough to extend all through holding member 29 up to the entire width of holding member 27. Nuts 51,53 are screwed at both ends of the bolt until the bolt assembly is considered firmly secured to connect both holding members 27, 29. When it is considered that the warp is not sufficiently tense, it is merely sufficient to screw nuts 53 until the desired tension has been obtained by drawing the two holding members 27, 29 towards one another.

Referring again to FIG. 1, it will be seen that both shoulders 35 of the lower transverse holding member 29 are provided with pins 55; these pins 55 are such that they can be inserted in holes 57 which are formed along the upright members 9, 11 in the rear face thereof. By selecting a proper hole 57, for inserting pins 55, it will be possible to adjust the lowermost holding member 29 at a selected height at the rear of the frame. This will enable to move the warp 25 lengthwise from one selected position to another selected position at the front of the frame. In so doing, it will be understood that the assembly of both holding members 27, 29 will move in the direction indicated by the arrow 31. It will be understood that as the work progresses, the holding members 27, 29 will gradually move upwards along the upright members 9, 11 until the high warp tapestry is finished. Obviously, when a new warp 25 is mounted on the loom 1 for making another high warp tapestry, it is understood that the holding members 27, 29 will be lowered to their lowermost position at the back of the frame.

Figure 3:
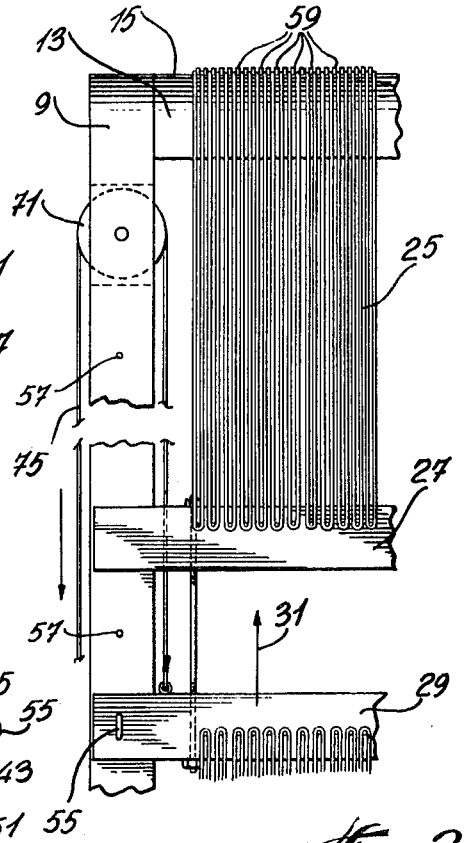
FIG. 3 is a view showing the threads of the warp passing over the upper guide bar, through a comb provided therefor.

Referring now to FIG. 3, it will be seen that the loom 1 also comprises a guide bar comb 59 which consists of a row of nails which are vertically driven into the uppermost part 15 of the upper half rounded elongated member 13. The purpose of the guide bar comb 59 is to separate the threads of the warp 25 all as shown in FIGS. 1 and 3.

Finally, when the warp is mounted on the loom, there is provided as in any other standard loom, a separation rod 61 which is used to separate the threads of the warp 25, in known manner.

If the loom is designed to create small size high warp tapestry, the holding members 27, 29 can easily be moved by hand to be fixed at the levels of the different holes 57. However, when the loom 1 is designed for making large size high warp tapestry, such as in the case of the device illustrated in FIG. 1, it is necessary to provide auxiliary means to lift the holding members 27, 29 along the upright members 9, 11 at the rear of the frame. For this purpose, the loom 1 comprises a crank box 63 which is mounted along side each of the upright members 9, 11, near the base 3, 5, 7 of the loom.

Inside the crank box 63, there is a first pulley 65 which is mounted to rotate in the crank box and a crank 67 is being mounted outside the box 63 so as to be operatively connected to the first pulley 65 and operate in the direction indicated by the arrow 69 in order to lift the assembly of holding members 27, 29 upwardly along the upright members 9, 11. There is a second pulley 71 which is freely rotatable in a mortise 73 practiced in each of the upright members 9, 11 all as shown in FIG. 1 of the drawings. A cord 75 is attached in known manner (not shown) at one end in the first pulley 65 in order to be wound or unwound over the pulley 65 when operating the crank 67. The cord 75 then climbs alongside a corresponding upright member 9, 11 exteriorly thereof, until it becomes engaged by the pulley 71 to ride over it. After, the cord 75 descends alongside a corresponding upright member 9, 11 interiorly thereof until the other end of the cord becomes attached at 77 to the lower transverse holding member 29. This should help in enabling to upwardly or downwardly slide the assembly of upper and lower holding members 27, 29 relative to the upright members 9, 11 while simultaneously moving the warp 25 lengthwise at the front of the frame.

The operation of the loom according to the invention is quite simple. The warp is mounted on the loom by hooking the threads at the upper end 45 unto the comb 41. The warp is then guided over the upper guide bar 13 while simultaneously separating the various threads by means of the comb 59. Then, the warp is allowed to pass under the lower guide bar 19 after which the threads at the lower end of the warp 25 are hooked unto the nails of the comb 43. Then, the operator adjusts the holding members 27, 29 relative to one another by screwing knots 53 thereby drawing the holding members 27, 29 towards one another until sufficient and uniform tension of the warp has been obtained.

It will be realised that notwithstanding the variable thicknesses which are obtained when producing the high warp tapestry, this should have no influence whatsoever on the tension of the warp which is maintained by the holding members 27, 29. Even if for some reasons, there would be some slackening effect or the tension might become uneven, this could easily be corrected by adjusting the various bolts and nut assemblies 49, 53.

In this manner, when creating the high warp tapestry if the tension of the warp decreases in quantity and uniformity, it will merely be sufficient to tighten the bolt assemblies in order to regain the amount and uniformity of the desired tension.

Then, when the working level exceeds a predetermined height at the front of the frame, it will merely be sufficient to disengage the pin 55 from a pair of holes 57 at the same level and to reinsert the pins into upper holes 57 along the upright members 9, 11 so as to enable a downward lengthwise movement of the warp 25 at the front of the frame. After this operation, the holding members will again be adjusted with respect to one another by using the bolt assemblies 49, 53 in order to regain sufficient tension of the warp.

If the process involves the creation of a large size tapestry, one has to operate with a large loom. In such a case, it might be difficult to move the holding members 27, 29 upwardly along the upright members 9, 11 at the rear of the frame. In such a case, the loom is provided with a crank box 63 and crank 67 which will be operated in the direction indicated by the arrow 69 in order to help in lifting the assembly of holding members 27, 29, until the desired level has been reached.

Otherwise, the operation of the loom is obvious to anyone skilled in the art.

I claim:

1. In a loom for high warp tapestry which is made of a substantially rectangular frame mounted on a base, and wherein said frame is adapted to receive a warp in downwardly displaceable fashion along its length, the improvement wherein said frame is made of two substantially parallel upright vertical members, an upper guide bar and a lower guide bar, said upper guide bar and said lower guide bar having means to permit sliding of said warp along said upper and lower guide bars, a pair of transverse horizontal elongated holding members which are adapted to slide along said upright vertical members at the rear of the frame in parallel fashion to one another, hooking means on said elongated holding members to separately hook and retain the ends of said warp, means for drawing said holding members closer to one another to increase the rigidity on said warp, and means for fixedly mounting one of said holding members relative to said upright members.

2. In a loom according to claim 1, wherein said upper and lower guide bars each consist of a substantially half rounded elongated member, the upper half rounded member being mounted between the upper ends of said upright members with the rounded portion of the upper half rounded member facing upwards, and the lower member being mounted between the upright members, with the rounded portion of the lower half rounded member facing downwards and at a distance from the lower ends of said upright members which is sufficient to enable a finished portion of the high warp tapestry to slide lengthwise around said rounded portion of said lower member without disturbance from said base, while the upper portion of the warp simultaneously slides lengthwise over said rounded portion of said upper member.

3. In a loom according to claim 1, which comprises a comb provided over said upper half rounded elongated member to separate threads of said warp.

4. In a loom according to claim 1, wherein said comb consists of a row of nails vertically driven into the uppermost part of said upper half rounded elongated member.

5. In a loom according to claim 1, wherein said hooking means are formed with a comb disposed on each of said holding member, where the ends of said warp are hooked.

6. In a loom according to claim 1, wherein each of said comb comprises a row of nails horizontally driven in the outer face of each of said holding members.

7. In a loom according to claim 1, wherein each of said holding members has a shoulder defining cut out portion at both ends thereof, to enable the holding member to fit between said upright members in slidable relationship thereto, while the shoulders respectively rest over said upright members against the rear face thereof in ridable relationship thereto.

8. In a loom according to claim 7, wherein said means for drawing said holding members closer to one another comprise a plurality of bolt assemblies connecting both said holding members together and which can be tightened to draw said holding members towards one another.

9. In a loom according to claim 8, which comprises pins provided in both said shoulders of the lowermost holding member, said pins being insertable into holes provided along the upright members in the rear face thereof to fixedly adjust said lowermost holding member at a selected height at the rear of said frame, thereby enabling to move the warp lengthwise from one selected position to another selected position at the front of said frame.

10. In a loom according to claim 9, which comprises cranking means provided on said frame and associated with said lowermost holding member to help in causing upward sliding of said holding member relative to said upright members while simultaneously moving said warp lengthwise downwardly at the front of said frame.

11. In a loom according to claim 10, wherein said cranking means comprise a crank box mounted alongside each said upright member near said base a first pulley which is rotatable in said crank box, and a crank outside said box, said crank being operatively connected to said first pulley, a second pulley freely rotatable in a mortise formed in said upright member, and a cord attached at one end in said first pulley and adapted to be wound and unwound over said first pulley when operating said crank, said cord then climbing alongside said upright member exteriorly thereof until it rides over said second pulley, after which said cord descends alongside said upright member interiorly thereof until the other end of said cord becomes attached to said lower transverse holding member, thereby enabling to upwardly or downwardly slide the assembly of said upper and lower holding members relative to said upright members.

12. In a loom for high warp tapestry which is made of a substantially rectangular frame mounted on a base, said frame being made of two parallel upright vertical members, an upper guide bar consisting of a first substantially half rounded elongated member which is mounted between the upper ends of said upright members with the rounded portion of said first half rounded member facing upwards, a lower guide bar consisting of a second substantially half rounded elongated member which is mounted between said upright members with the rounded portion of said second half rounded elongated member facing downwards, said lower guide bar being at a distance from the lower ends of said upright members which is sufficient to enable a finished portion of the high warp tapestry to slide lengthwise around said rounded portion of said second half rounded elongated member without disturbance from said base while the upper portion of the warp substantially slides lengthwise over said rounded portion of said first half rounded member, a pair of transverse horizontal holding members which are parallel to one another and are adapted to slide along said upright vertical members at the rear of said frame each of said holding member having a shoulder defining cut out portion at both ends thereof to enable the holding member to fit between said upright members in slidable relationship thereto while the shoulders respectively rest over said upright members against the rear face thereof in ridable relationship thereto, each of said holding members being provided with a comb consisting of a row of nails horizontally in the outer face of each of said holding member, said comb of said upper holding member to hook the threads at the upper end of said warp, said comb of said lower holding member to hook the threads at the lower end of said warp, a plurality of bolt assemblies connecting both said holding members together and which can be tightened to draw said holding members towards one another, pins provided in both said shoulders of the lowermost holding member, said pins being insertable into holes provided along the upright members in the rear face thereof to fixedly adjust said lowermost holding member at a selected height at the rear of said frame, thereby enabling to move the warp lengthwise from one selected position to another selected position at the front of said frame, and a guide bar comb consisting of a row of nails vertically driven into the uppermost part of said upper half rounded elongated member, said guide bar comb to separate the threads of said warp, so constructed and arranged that when creating said high warp tapestry, if tension of said warp decreases in quantity and uniformity, said bolts assemblies are tightened to regain said quantity and uniformity of tension, and when working level exceeds a predetermined height at the front of said frame, said pins are desingaged from a pair of holes and are reinserted into upper holes along said upright members so as to enable a downward lengthwise movement of said warp at the front of said frame, after which said holding members are adjusted with respect to one another by means of said bolt assemblies to regain sufficient rigidity of said warp.

13. In a loom according to claim 12, which comprises a crank box mounted alongside each of said upright member near said base, a first pulley which is rotatable in said crank box, and a crank being mounted outside said box, said crank being operatively connected to said first pulley, a second pulley freely rotatable in a mortise formed in each said upright member, and a cord attached at one end in said first pulley and adapted to be wound or unwound over said first pulley when operating said cran, said cord then climbing alongside said upright member exteriorly thereof until it rides over said second pulley, after which said cord descends alongside said upright member interiorly thereof until the other end of said cord becomes attached to said lower transverse holding member, thereby enabling to upwardly and downwardly slide the assembly of said upper and lower holding members relative to said upright members while simultaneously moving said warp lengthwise at the front of said frame.

* * * * *